US007891125B1

(12) United States Patent
Piccirillo

(10) Patent No.: US 7,891,125 B1
(45) Date of Patent: Feb. 22, 2011

(54) THERAPEUTIC METHODS AND APPARATUSES FOR PROCESSING AN EMOTION TRIGGERING EVENT

(76) Inventor: Emily H. Piccirillo, 822 Gist Ave., Silver Spring, MD (US) 20910

( * ) Notice: Subject to any disclaimer, the term of this patent is extended or adjusted under 35 U.S.C. 154(b) by 0 days.

(21) Appl. No.: 10/235,568

(22) Filed: Sep. 6, 2002

Related U.S. Application Data

(60) Provisional application No. 60/317,489, filed on Sep. 7, 2001.

(51) Int. Cl.
*A47G 1/06* (2006.01)

(52) U.S. Cl. ..... 40/799

(58) Field of Classification Search ..... 40/799, 40/661.05, 661
See application file for complete search history.

(56) References Cited

U.S. PATENT DOCUMENTS

| | | | | |
|---|---|---|---|---|
| 839,251 | A | | 12/1906 | Albrecht et al. |
| 2,279,164 | A | | 4/1942 | Gettleman |
| 2,570,678 | A | | 10/1951 | Houser |
| 2,807,108 | A | | 9/1957 | Fisher |
| 3,898,870 | A | * | 8/1975 | Jacobson ..... 40/799 X |
| 4,222,189 | A | | 9/1980 | Kamei |
| 4,368,585 | A | * | 1/1983 | Meltzer et al. ..... 40/661.05 X |
| 5,219,184 | A | | 6/1993 | Wolf |
| 5,269,084 | A | | 12/1993 | Best et al. |
| 5,318,327 | A | | 6/1994 | Daneshvar |
| 5,414,948 | A | * | 5/1995 | Kudo ..... 40/661.05 X |
| 5,437,478 | A | | 8/1995 | Gaines |
| 5,619,291 | A | | 4/1997 | Putnam |
| 5,676,551 | A | | 10/1997 | Knight et al. |
| 5,725,472 | A | | 3/1998 | Weathers |
| 5,729,921 | A | | 3/1998 | Rojas |
| 5,732,231 | A | | 3/1998 | Evans, III |

(Continued)

OTHER PUBLICATIONS

David Feinstein and Peg Elliott Mayo, Mortal Acts, 1993, Harper Collins, New York City, NY, Specification 0014.

(Continued)

*Primary Examiner*—Joanne Silbermann
(74) *Attorney, Agent, or Firm*—Dickstein Shapiro LLP

(57) ABSTRACT

Therapeutic methods and apparatuses for processing emotions and cognitions relating to an event of substantial significance to a person, including but not limited to: death of another person or animal; loss of another person, an animal, or an object; separation from another person, an animal, or an object; relocation, graduation, adoption, incarceration, retirement, transitioning between employers, caregivers, etc., and other significant events. Some of the methods and apparatuses allow a person who experiences an emotion triggering event to impart a personalized message to a token, to transfer the token to another person, an animal, or an object, and to affix a memento to a frame, thereby assisting the person to let go or to hold on. Other methods and apparatuses allow a person—such as a professional therapist, friend, relative, caregiver, neighbor, co-worker, pastor, or acquaintance—to provide therapy to another person by assisting the other person to let go or to hold on. The methods and apparatuses may include assistance in selecting the personalized message or the memento, display or preservation of the memento, instructions for use of the methods or apparatus, terms suggesting a personalized message, identifiers, decorations including common cultural images and symbolic connections, inscriptions, symbolic shapes, means to display, means to attach, means to affix, means to preserve, means to protect, mounts, and other features.

15 Claims, 7 Drawing Sheets

U.S. PATENT DOCUMENTS

| | | | |
|---|---|---|---|
| 5,915,734 | A | 6/1999 | Minehart |
| 5,954,369 | A | 9/1999 | Seabrook |
| 5,956,877 | A | 9/1999 | Raasch et al. |
| 5,987,720 | A | 11/1999 | Yamamoto |
| 6,186,145 | B1 | 2/2001 | Brown |
| 6,203,070 | B1 | 3/2001 | Richardson |
| 6,322,503 | B1 | 11/2001 | Sparhawk, Jr. |
| 6,385,874 | B1 | 5/2002 | Tsonas |
| 6,422,558 | B1 | 7/2002 | Chambers |
| 6,432,070 | B1 | 8/2002 | Talish et al. |
| 6,436,060 | B1 | 8/2002 | Talish |
| 6,694,296 | B1 | 2/2004 | Alleva et al. |
| 2002/0009696 | A1 | 1/2002 | Lui et al. |
| 2002/0040670 | A1 | 4/2002 | Hornak |
| 2002/0070498 | A1 | 6/2002 | Chambers |
| 2002/0082855 | A1 | 6/2002 | Dickey et al. |

OTHER PUBLICATIONS

Steve Zeitlin and Ilana Harlow, Giving a Voice to Sorrow, 2001, The Berkley Publishing Group, New York City, NY, Specification 0014.

Dr. Alan D. Wolfelt, A Child's View of Grief, 1990, Service Corporation International, Specification 0004.

Peter Homans, Symbolic Loss, 2000, The University Press of Virginia, Specification 0006.

Ellen Bass and Laura Davis, The Courage to Heal, 1998, Santa Cruz, CA, Specification 0006.

Dr. William C. Kroen, Helping Children Cope with the Loss of a Loved One, 1996, Free Spirit Publishing Inc., Minneapolis, MN, Specification 0012.

William Butler Yeats, The Second Coming (1922), Specification 0023.

William Shakespeare, Macbeth (Act IV, Scene iii, 245-46) (1623), Specification 0005.

* cited by examiner

THERAPEUTIC METHODS AND APPARATUSES FOR PROCESSING AN EMOTION TRIGGERING EVENT

CROSS REFERENCE TO RELATED APPLICATION

This application claims priority from U.S. Provisional Application Ser. No. 60/317,489, filed Sep. 7, 2001, which is hereby incorporated by reference in its entirety.

GOVERNMENT INTERESTS

Not Applicable

SEQUENCE LISTING OR PROGRAM

Not Applicable

BACKGROUND OF THE INVENTION

1. Field of the Invention

The present invention relates generally to human psychology and therapeutic devices. More specifically, the present invention relates to therapeutic methods and apparatuses for processing emotions or cognitions relating to an event of substantial significance to a person, including but not limited to the death of another person or animal, the loss of another person, an animal, or an object, or separation from another person, an animal, or an object significant to the person, a relocation, a graduation, adoption, incarceration, retirement, transitioning between employers, caregivers, and the like, etc. (hereinafter collectively referred to as an "emotion triggering event"). Some of the methods and apparatuses allow a person who experiences an emotion triggering event to impart a personalized message to a token, to transfer the token to the other person, animal, or object (hereinafter collectively referred to as the "source" of the emotion triggering event), and to frame a memento relating to the source, thereby assisting the person to let go of and hold on to the source.

2. Discussion of the Related Art

It is well known in the psychological and other emotional and cognitive therapy professions that people often experience a range of emotions and cognitions when emotion triggering events occur in their lives. It is also well known that people often lack self-awareness of the existence or the sources of the emotion triggering events, and that people often need assistance in identifying the existence and the sources of emotions and cognitions relating to the emotion triggering events or their sources, and in processing (including but not limited to reconciling) those emotions and cognitions.

More specifically, it is known that people experience grief, anger, guilt, confusion, anxiety, relief, worry, and other related emotions and various cognitions when another person, an animal, or a thing of significance to them has died, been lost, or has become temporarily or permanently and voluntarily or involuntarily separated (hereinafter collectively referred to as a "separation source" of a "separation event"). For example, Alan D. Wolfeld, Ph.D., *A Child's View of Grief: A Guide for Caring Adults* (© 1990 published by Service Corporation International), at pages 8-18 discusses twelve dimensions of grief commonly experienced by bereaved children. In some cases, particularly with children and adolescents, the person does not recognize or represses the existence or nature of the emotions or cognitions, their relation either to the separation source or the separation event, or even the existence of a separation source or a separation event.

Throughout history, there has been a recognized need for effective methods of processing emotions or cognitions relating to a separation source, such as William Shakespeare's *Macbeth* (Act IV, Scene iii): "Give sorrow words; the grief that does not speak Whispers the o'er-fraught heart, and bids it break." Within these therapeutic professions, it is a known method to direct a person to write down their emotions and cognitions about a separation source. The therapist may direct that the writing be in the form of a message to the separation source. The message need not be a handwritten inscription, but may be or may include a drawing, an analog or digital sound or video recording, a typewritten or computer-generated document, or any other form of fixed expression in a tangible medium. Similarly, the message may be a physical object with symbolic significance either to the person or to the separation source. In some cases, the message is retained by the person or discarded. In other cases the message may be transferred to the separation source or the environment of the separation source. Where the separation source is a deceased person or animal (hereinafter referred to as a "deceased"), the message may be placed with or in the environment of the physical remains of the deceased. The actions of writing the message and of giving it to the separation source promote therapy (understood broadly in the alternative senses of providing, performing, or receiving treatment or rehabilitation for a disease or condition, analysis, healing, remedial training, caring, etc.), including communication and dialogue between the therapist and the person experiencing the separation event. The action of writing and giving the message to the source helps the person to "let go" of the source.

Other methods to assist a person to let go also are known. For example, Peter Homans, *Symbolic Loss The Ambiguity of Mourning and Memory at Century's End* (© 2000, published by University of Virginia Press), at page 3 (cited here solely for its description of earlier art) discusses generally how mourning assists the process of letting go of a separation source that is a deceased person. Similarly, Ellen Bass and Laura Davis, *The Courage to Heal: A Guide for Women Survivors of Child Sexual Abuse* (© 1988, published by Harper & Row), at page 120 discuss ways to move beyond grief and pain by fully experiencing, honoring, expressing, and assimilating the feelings. Other methods to assist letting go include oral counseling, art therapy, play therapy, music therapy, horticulture therapy, psychodrama, creative writing (of songs, stories, poems, and the like), prayer, meditation, chanting, etc.

It is also common, in response to reading a publication of a therapist or another person or without any direction from a therapist or another person, for a person experiencing a separation event to provide himself or herself with therapy by writing to or about the separation source, or otherwise providing a message to assist letting go. For example, where the separation source is a deceased person or animal, a letter may be written to the deceased or a eulogy or obituary may be written about the deceased. Similarly, it is common for a person to leave at a grave site or bury with a deceased a writing authored by the deceased or another person, flowers, a photograph, objects belonging to or relating to the deceased, and other sentimental or memorial items. For example, U.S. Pat. No. 5,987,720 to Yamamoto (cited here solely for its description of earlier art) discusses encasing in a tomb memorabilia pertaining to the life history of a deceased and objects and information pertaining to the continuation of life in some form.

These methods and devices for performing these methods are often unsuccessful or ineffective in regard to processing of emotions or cognitions associated with an emotion triggering event. For example, therapists often find that clients, particularly children, for a variety of reasons are resistant to writing or drawing a message to a deceased. Similar resistance is encountered in regard to using existing devices, such as coloring books or workbooks, whether or not specifically designed and designated for these purposes. Lack of perceived value or lack of motivation is encountered when the message is created without an intent for it to be transferred to the source. Clients may view the processes of, for example, writing a message, creating a journal, or leaving at a grave site a message symbolized by a physical object to be disconnected from their emotions or cognitions or to be an additional burden or a source of additional significant emotions or cognitions.

Even when clients are willing to overcome such resistance, they may encounter difficulty identifying the source of an emotion triggering event, the need to let go, or the contents of an appropriate message. Similarly, clients may find it difficult to focus their attention or to limit the message, given the wide range of potential messages that might be included.

Some of these methods fail to reduce client's processing activities to a fixed medium of expression, lack sufficient permanence, and do not endure beyond the immediate physical and temporal context of their creation with the therapist. Conversely, existing devices having greater permanence than the body of a deceased fail to maintain the symbolic connection of the meaning and physical embodiment of the message with the spirit and physical embodiment of the deceased.

Existing devices for assisting clients to write messages to or leave objects with the source (such as a sheet of paper, a workbook, a journal, a photograph, flowers, etc.) and for overcoming such resistance or difficulties (such as a printed paper sheet configured with a display frame to encourage drawing) are not designed or designated for these particular purposes, require significant effort or abstract thought, do not encourage experiential therapies, or otherwise are not well-suited to solve these problems. Similarly, existing devices and commonly stocked products typically are not distributed principally and primarily for these purposes or in association with information relating to these purposes, are not configured in symbolic shapes (such as: a circle, which represents the cycle of life, unity, infinity, perpetuity, wholeness, etc., and which is associated with the earth, the sun, the womb, eggs, eyes, breasts, vessels or containers that may be emptied or filled, safety or security because of their continuous, completed, and uninterrupted nature, etc.; a heart, which represents love, life, health, strength, emotion, etc., and which is associated with positive responses, strong relationships, etc.; and the like), or do not have decorations, including symbols drawn from the culture and associated with emotion triggering events (such as religious symbols—crosses, stars, hands in prayer, candles, etc.—cultural symbols—national flags, American eagles, African Adinkra, Japanese cranes, etc.—love symbols—hearts, flowers, doves, teddy bears, etc.—symbols of eternity—oceans, skies, diamonds, sun/moon pairing, etc.—symbols of an afterlife—butterflies, angels, rainbows, spirals, etc.—and other types of shapes and designs performing such symbolic functions within the relevant culture) (hereinafter collectively referred to in the context of a deceased as "the group of common cultural images associated with bereavement."). Nor do these devices and commonly stocked products typically comprise features specifically designed to overcome the resistance or difficulties noted above.

It is further known in therapeutic professions to direct a person experiencing an emotion triggering event to identify a memento (also known as a keepsake) that they associate with the source. The therapist may further direct the person to retain or to preserve the memento, for example by placing it in an enclosure or frame, to display the memento, or otherwise to acknowledge the importance of the memento. The memento helps the person to "hold on" to the source. For example, William C. Kroen, Ph.D., LMHC, *Helping Children Cope with the Loss of a Loved One: A Guide for Grownups* (© 1996, published by Free Spirit Publishing Inc.), at pages 78-80, describes in regard to a deceased the display of photographs, making of photo albums, visiting of graves, writing of poems, planting of trees, making of charitable donations, remembering of a deceased on holidays, and establishing of commemorative traditions.

More specifically, it is also common for a person experiencing a separation event to identify, preserve, or display a memento associated with the source. For example, a person may keep a memory box, create a home altar, preserve a memorial room, or otherwise store a memento in a holder or location. For another example, a person may create a memory journal, such as the memorial album described in U.S. Pat. No. 839,251 to Albrecht, which is formed to receive a photograph of a deceased and to record facts relating to the deceased. For yet another example, a person may create a memento containing a representation of or specimen from the source. These mementos come in many forms, such as jewelry, imprints, pendants, portraits, photo albums, collages, analog and digital sound or video recordings, or other tangible items.

Further, it is common for a person experiencing a separation event to perform a memorial service or ritual, such as burning a candle in memory of or containing the name of the deceased. For example, Steve Zeitlin and Ilana Harlow, *Giving a Voice to Sorrow: Personal Reponses to Death and Mourning* (© 2001, published by The Berkeley Publishing Group), at pages 5, 11 (cited here solely for its description of earlier art) discusses three types of narrative responses to grieving: storytelling, rituals of remembrance, and commemorative art, the first and last of which may themselves become rituals. Similarly, David Feinstein and Peg Elliott Mayo, *Mortal Acts Eighteen Empowering Rituals for Confronting Death* (© 1993, published by HarperCollins), at table of contents and pages 1-17, describes eighteen rituals for addressing a bereavement in regard to a deceased. It is also common for another person (such as a relative, a caregiver, a friend, a co-worker, a neighbor, an acquaintance, or even a therapist) to provide emotional support or guidance by providing the person with writings authored by themselves or others, sympathy cards, flowers, food, comfort products (such as stuffed animals), or other items.

These methods and devices for performing these methods are often unsuccessful or ineffective in regard to processing of emotions or cognitions associated with an emotion triggering event. The methods and devices are not specifically designed and designated for addressing the needs of letting go of and of holding on to a source of an emotion triggering event. They are directed at accomplishing only a single objective or an objective different from the processing of emotions or cognitions, such as expressing emotional support to a person without addressing the person's need to let go of or hold on to the source. For example, U.S. Pat. No. 2,807,108 to Fisher discloses tags containing an identification message that may be left with a deceased, specifically designed and configured for the objectives of identification or of signaling. For another example, U.S. Pat. No. 5,269,084 to Best discloses a greeting card configured for affixing a photograph, U.S. Pat. No. 5,318,327 to Daneshvar discloses a romantic greeting card containing a greeting message receiving zone for imparting a message, and U.S. Pat. No. 5,437,478 to Gaines discloses a greeting card for recording a monetary gift with a detachable receipt. It is apparent that such greeting card inventions are not specifically designed and designated for letting go of and holding on to a separation source, and do not contain features to effectuate those objectives. This is true even if messages or symbols associated with emotion triggering events were included with or imparted to those cards and even if those cards or portions of the cards were transferred to the source, its environment, or a location of significance to the source or to the person in regard to the source (hereinafter collectively referred to as "a significant location relating to the source").

Limitations similar to those noted above in regard to methods and devices for letting go also apply to methods and devices for holding on. For example, therapists often find that clients, particularly children, for a variety of reasons are resistant to creating a memory journal of a deceased—as when such creation is perceived as a burden or is associated with homework—and similar resistance is encountered in regard to using existing devices—such as albums for displaying and storing photographs—to create a memento of a deceased.

Even when clients are willing to overcome such resistance, they may encounter difficulty identifying the source of an emotion tnggenng event, the need to hold on, or the contents of an appropriate memento. Similarly, clients may find it difficult to focus their attention or to choose a memento, given the wide range of potential mementos that might be selected.

Existing devices for assisting clients to create a memento—such as a sheet of paper, art supplies, photographs, and holders of various sorts—and for overcoming such resistance and difficulties—such as a picture frame or the mourning emblems disclosed in U.S. Pat. No. 2,570,678 to Houser or urns to hold cremation remains—are not specifically designed or designated for these purposes, require significant effort or abstract thought, do not encourage experiential therapies, or otherwise are not well-suited to solve these problems. Similarly, existing devices and commonly stocked products typically are not distributed principally and primarily for these purposes or in association with information relating to these purposes, are not configured in symbolic shapes, or do not have symbols drawn from the culture and associated with emotion triggering events in general and the group of common cultural images associated with bereavement in particular. Nor do these devices and commonly stocked products typically comprise features specifically designed to overcome the resistance or difficulties noted above. Nor do these devices and commonly stocked products typically comprise features specifically designed to form or to strengthen a symbolic connection between combinations of the person, the source, and the device.

Further, if a plurality of these methods or devices for letting go of or for holding on were practiced or used in combination, they would have to be employed seriatim, without any intrinsic connection or without having a potentially extended duration, further impeding the objectives of processing emotions or cognitions by letting go of and holding on to a source in close spatial or temporal proximity. Existing methods and devices also suffer in their effectiveness at accomplishing either of the objectives of letting go of or holding on to a source, because the methods and devices at most are perceived to be designed and designated solely to accomplish one and not both of these objectives. At present, there are no methods or devices specifically designed to effectively accomplish the therapeutic objectives of letting go of and holding on to a source.

SUMMARY OF THE INVENTION

Accordingly, the present invention solves the above-described problems by providing—and it is one object of the invention to provide—unitary methods and apparatuses for assisting a person to let go of and to hold on to a source of an emotion triggering event. In one embodiment, the invention may be used by a professional therapist to provide therapy to a person who has experienced a separation event. In another embodiment, the invention may be used by a non-professional therapist (such as hospice volunteers, nurses, teachers, pastors, friends, relatives, caregivers, neighbors, co-workers, acquaintances, etc.) seeking to provide therapy to the person who has experienced such a separation event. In yet another embodiment, the invention may be used by the person who has experienced such a separation event.

Further objects of the invention addressed in various embodiments are to provide more effective therapeutic methods and apparatuses for a person to let go of or hold on to a source of an emotion triggering event, by providing methods and apparatuses: specifically designed and designated for use in therapeutic processes of letting go of and holding on to a source; distributed principally and primarily for use in therapeutic processes of letting go of and holding on to a source: accompanied by information relating to therapeutic methods; designed to overcome various forms of resistance to or difficulties with therapeutic methods, including but not limited to writing a personalized message to a source, transferring a token to a significant location relating to a source, or creating, retaining, displaying, or preserving a memento of a source; that encourage experiential therapeutic methods of letting go of or holding on to a source; that assist identification, selection, creation, or transfer of a personalized message to a source; that assist identification, selection, creation, retention, display, or preservation of a memento of a source; that create a fixed expression of a personalized message having an appropriate permanence; that are configured in symbolic shapes; that have decorations (including but not limited to appropriate symbols); that have inscriptions (including but not limited to printed messages); and that form or strengthen a symbolic connection between a combination or permutation of the person, the source, and the method or apparatus.

Another object of the invention addressed in various embodiments is to facilitate therapeutic methods of letting go of or holding on to a source even without imparting a personalized message or creating a memento. For example, the invention may include transferring a token configured for imparting a personalized message and detached from a frame to a significant location relating to a source of an emotion triggering event. The invention, as specifically designed and designated solely for these purposes, promotes therapy by facilitating letting go of or holding on to the source.

An additional object of the invention addressed in various embodiments is to facilitate, or overcome resistance to or difficulties with, therapeutic methods of letting go of or holding on to a source, by forming or strengthening a symbolic connection or by promoting interaction between the person and the apparatus, the person and the source, or the person and the therapist through the process of performing the therapeutic method or of using the apparatus. For example, removal of a token of various embodiments may form a space in a frame that creates or strengthens a symbolic connection of the frame with the person. For another example, removal of the token may suggest an empty core that may be filled with a memento, creating or strengthening a connection of the apparatus to the emotional experience of the person, as reflected in common expressions relating to a separation event such as "It feels like there is a hole inside me," "It's like my heart was torn out." "There's an empty space inside that only the source can fill." etc. Similarly, filling the space with a memento may create or may strengthen a symbolic connection between the person and the source, with the device serving as a metaphor for the change in the relationship between the person and the source. For a further example, filling the space with a memento relating to the source may complete the apparatus in a symbolic reflection of the completion of the person only with the physical or spiritual presence of the source, forming or strengthening the symbolic connections among the person, the apparatus, and the source. Such symbolic connections may be further formed or strengthened by poetic, artistic, or other expressive inscriptions of all sorts, such as from William Butler Yeats, *The Second Coming* ("Things fall apart; the center cannot hold.").

A further additional object of the invention addressed in various embodiments is to facilitate therapeutic methods of letting go of or holding on to a source by widespread distribution of context-appropriate apparatuses specifically designed and designated for these purposes. For example, the invention may be distributed or donated to professionals, agencies, religious institutions, funeral homes, hospitals, hospices, and organizations (such as disaster relief agencies), schools for use by crisis intervention teams, etc., for specific or recurrent uses or for widespread uses in situations involving emotion triggering events of a large scale affecting many people (such as earthquakes, hurricanes, famine, epidemics, transportation accidents, terrorist attacks, school crises, etc.). Similarly, the invention may be configured specifically for such events, for use in relation to prominent public figures or celebrities, (such as religious leader, political leaders, royalty, entertainers, media figures, etc.), or for specific locations, cities, or regions (such as a religious, political, or culturally symbolic site, the city in which a terrorist action has occurred, a region subject to a natural disaster, etc.). The invention may be packaged and distributed with additional information or educational materials to assist selection of a personalized message or of a memento (such as information about how to use the apparatus, information describing the nature and the scope of the emotion triggering event, information about typical emotions and cognitions triggered by such an event, information about effective therapeutic methods for processing such emotions and cognitions, a brief biography or photograph of a celebrity, etc.).

Another additional object of the invention addressed in various embodiments is to facilitate therapeutic methods of communication in the context of counseling or providing emotional support. For example, the invention may include use of the methods or of the apparatuses to open a dialogue, clarify and eliminate misconceptions, provide reassurance, etc., between a person and a professional therapist or another person providing therapy or emotional support regarding the need for the person to let go of or hold on to a source. The methods and apparatuses, as specifically designed and designated solely for these purposes, promote and facilitate such communication.

The summary above outlines broadly some of the significant features and objects of the invention so that it will be easier to understand and appreciate the detailed description, importance, and contribution of the invention to the art. Additional features and objects of the invention are described and implied below that form the subject matter of the appended claims. Those skilled in the art will recognize additional features and objects of the invention in addition to those enumerated.

The description of the invention is not limited to the enumerated details of construction or of arrangement of the components or steps set forth below or illustrated in the drawings. The invention is capable of a wide range of unenumerated embodiments and of being practiced and carried out in various ways. Those skilled in the art will recognize that the disclosure provides the basis for designing other structures, methods, and systems for carrying out the purposes of the invention, and that the disclosure enables many obvious and non-obvious, foreseeable and unforeseeable ways to substitute elements of structure and function to accomplish stated and unstated benefits of the invention according to the same broad principles that are disclosed.

The phraseology and terminology are employed for the purpose of description and are not intended to be and should not be construed as limiting in any way. Similarly, the abstract is not to be construed as limiting the invention in any way, as its purpose is to enable the U.S. Patent and Trademark Office and the public generally (including persons unfamiliar with patent-specific or legal terms and phraseology) to quickly determine the nature of the invention disclosed in the application.

The claims are intended to include and should be construed to cover any and all embodiments of the claimed invention as enabled by the disclosure, and thus include within their scope any and all known, obvious or non-obvious, foreseeable, and unforeseeable equivalent structures, methods, and systems for the invention as claimed. Notwithstanding (and because of) the limits of descriptive language and the limits on the ability to foresee all embodiments of the invention, the claims are intended to include any and all embodiments of the invention that fall within the scope of protection permitted by law and should be construed broadly to do so. The scope of the invention for which protection is sought is defined in and by the claims, which are not intended to be and should not be construed as limited to enumerated elements or limitations, objects, or advantages of the invention in the abstract, summary, drawings, description of the drawings, detailed description of the invention, or any other part of the specification.

Although some of the important features, objects, and advantages of the invention generally and relative to the prior art have been described above, a better understanding of the invention and of its features, objects, and advantages may be obtained from the following drawings and descriptions, which also illustrate preferred embodiments of the invention.

REFERENCE NUMERALS IN DRAWINGS

Figure 1:
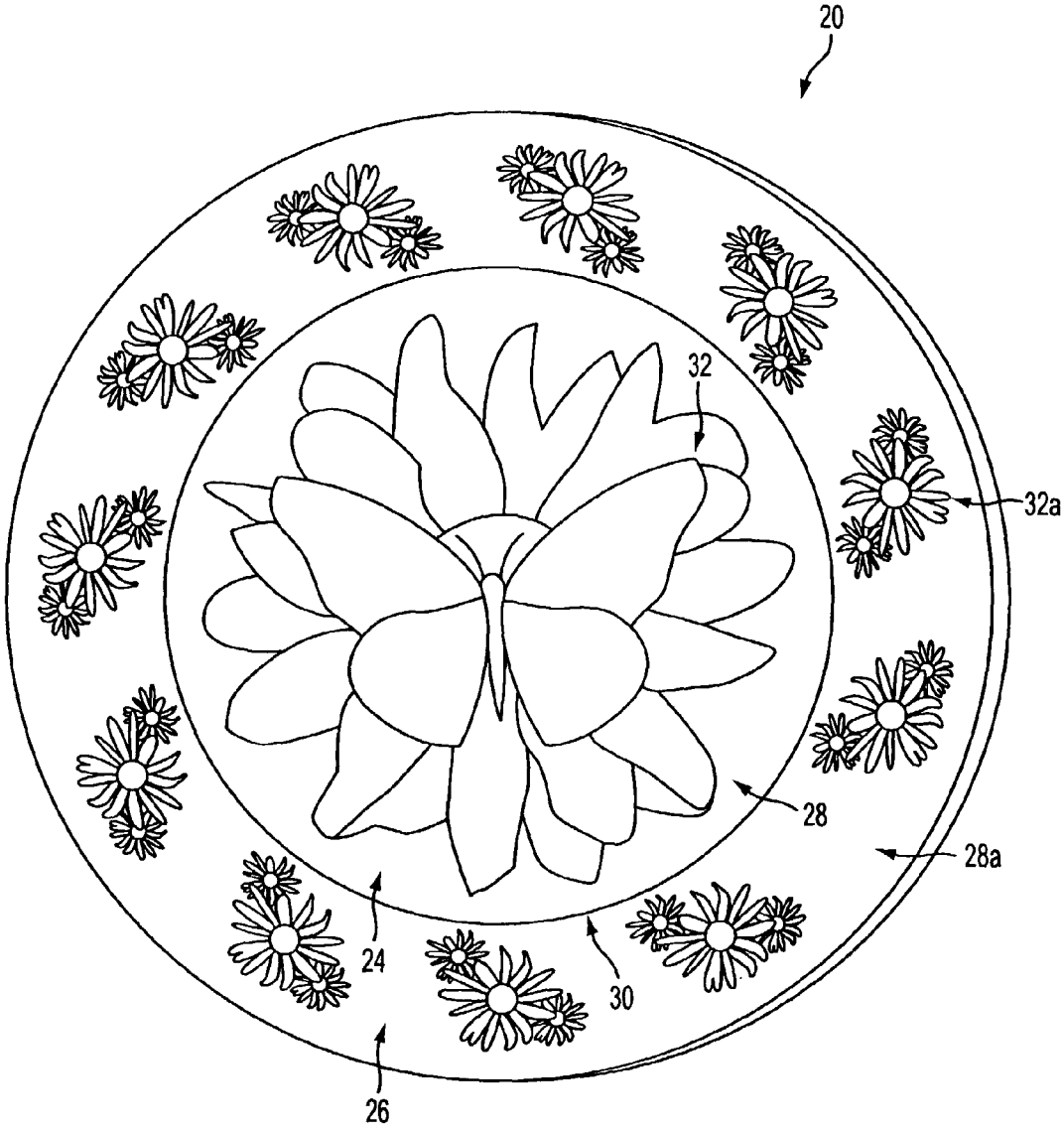
FIG. 1 shows a front perspective view of the apparatus in a preferred embodiment as a token and frame having a decoration on a face of the token and a decoration on a face of the frame that form a symbolic connection, the token and the frame forming a symbolic shape (a substantially circular border) and being detachably attached.
Figure 2:
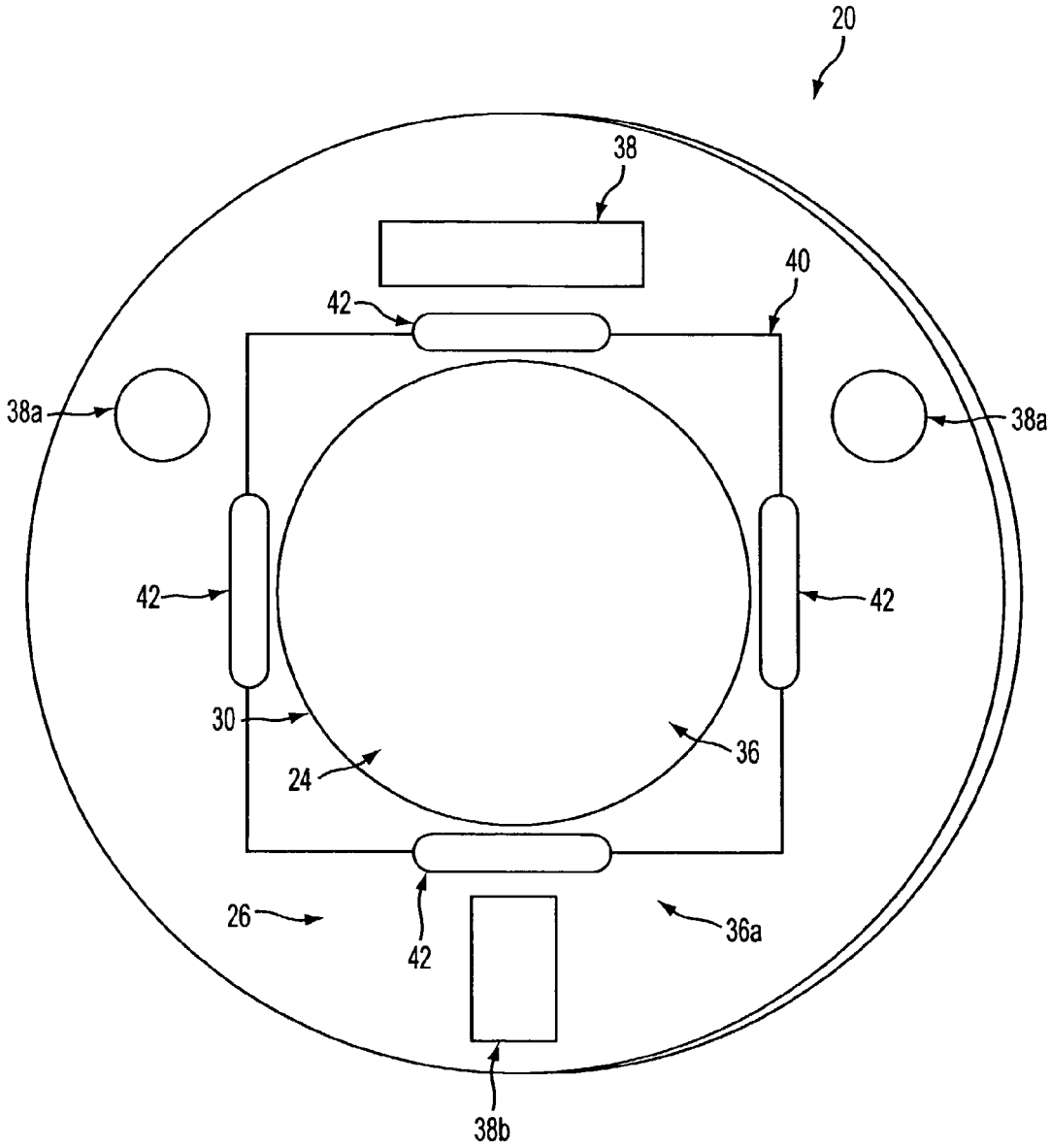
FIG. 2 shows a back perspective view of the apparatus in a preferred embodiment as a token and frame forming a symbolic shape and being detachably attached, with various means for displaying a memento (a hangtag, magnets, and a support) included with the frame and one means for preserving the memento attached to the frame (a transparent covering, such as a sleeve, attached with at least one adhesive strip).
Figure 3:
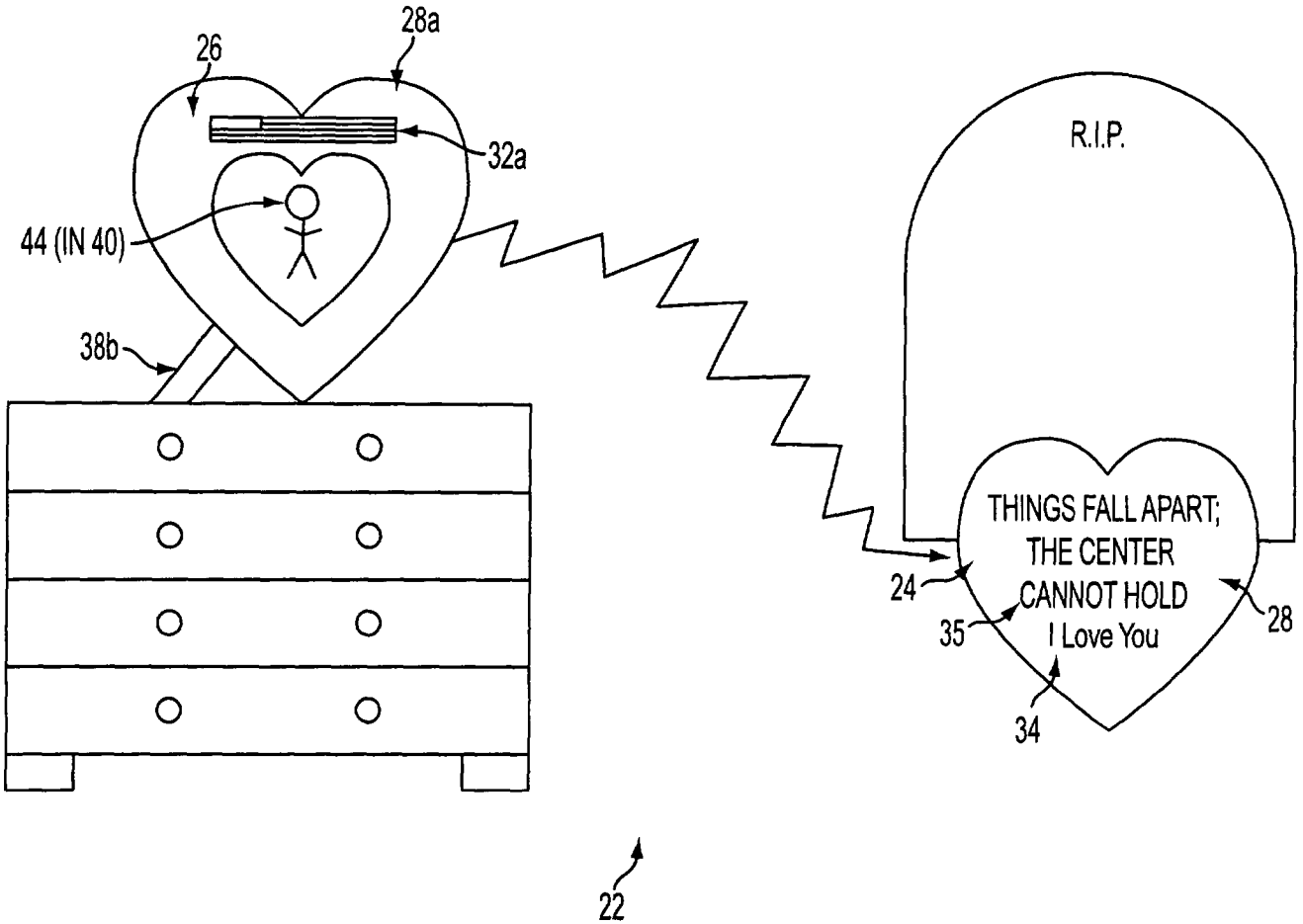
FIG. 3 shows a front plan view of the apparatus in a preferred embodiment as a frame having a decoration on a face of the frame, a memento affixed to the frame, means for preserving the memento (a transparent covering, in the form of a sleeve, into which the memento may be inserted), attached to the frame, and means for displaying the memento (a support), where the frame may be situated in a location to display the memento (on a dresser, which is not a part of the apparatus), and a detached and remotely located token forming a symbolic shape and having an inscription on the face of the token and a personalized message imparted to the token, where the remote location is a significant location relating to the source (at a grave marker, which is not a part of the apparatus).
Figure 4:
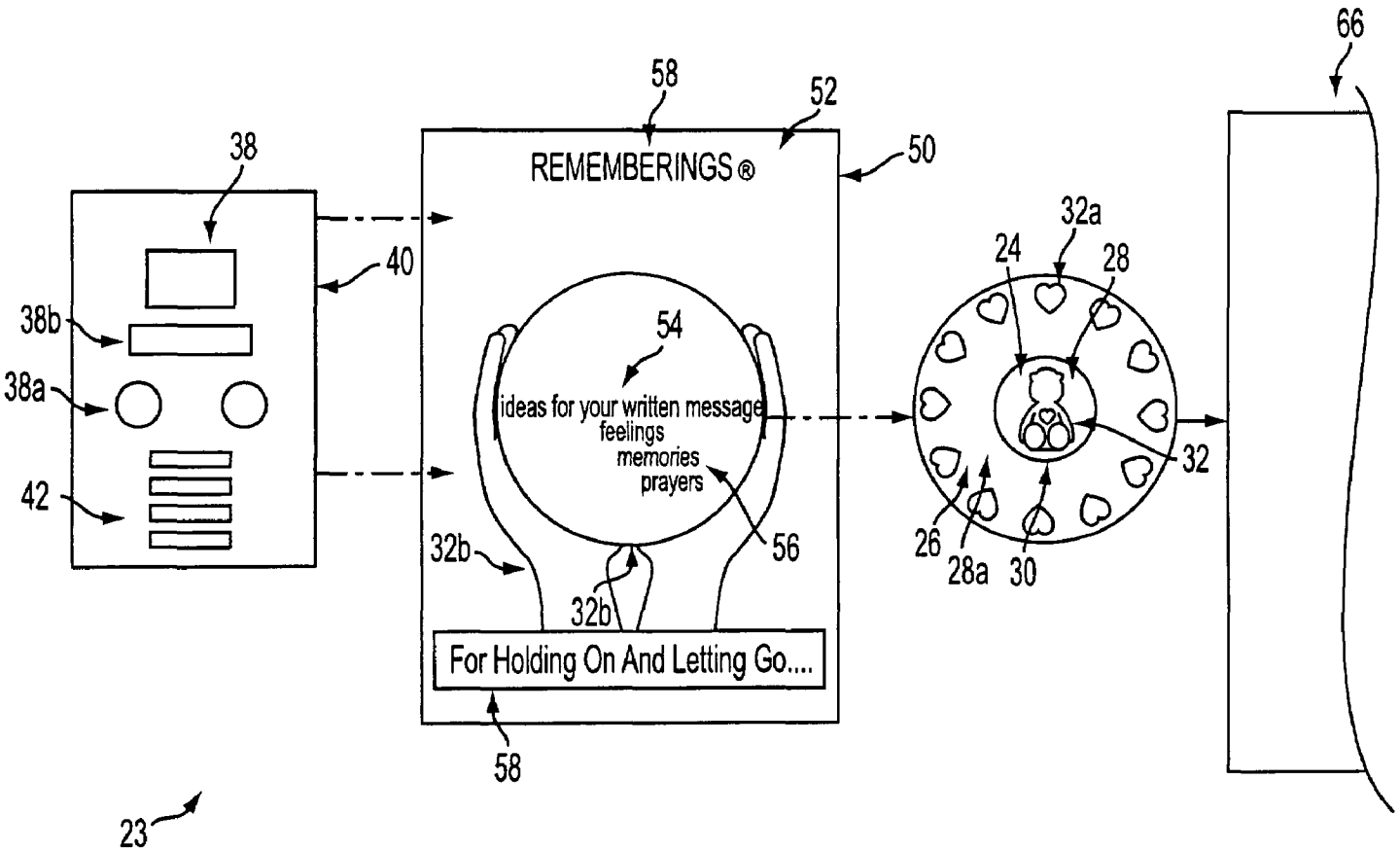
FIG. 4 shows a front elevation view of the exploded apparatus in a preferred embodiment having means for preserving the memento (a transparent covering, such as a sleeve), which may be detachably attached (by spot gluing) to a mount (a backer having on a face decorations, terms suggesting a personalized message, identifiers, and a direction for use), which may be detachably attached (by spot gluing) to a frame and token, with a decoration on the face of the token and a decoration on the face of the frame that form a symbolic connection. Means for attaching the preserving means to the frame (adhesive strips) and means for displaying the memento (a hangtag, magnets, a support) may be included with the preserving means (by enclosing them in the sleeve). Means for protecting the preserving means, displaying means, attaching means, mount, token, and frame may be provided (by insertion into and sealing of a transparent envelope).
Figure 5:
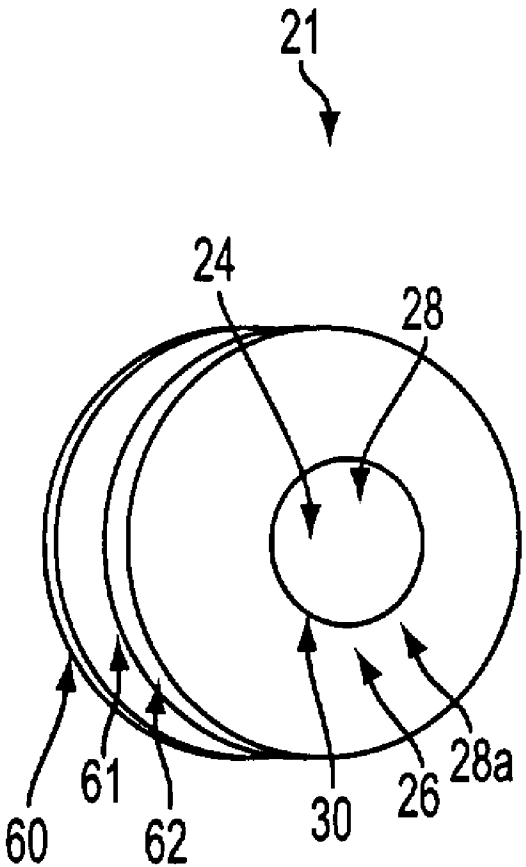
FIG. 5 shows a front perspective view of the apparatus in a preferred embodiment as a token and frame, including a first construction material (a card stock) laminated to a second construction material (a paper board) laminated to a third construction material (a cover stock).
Figure 6:
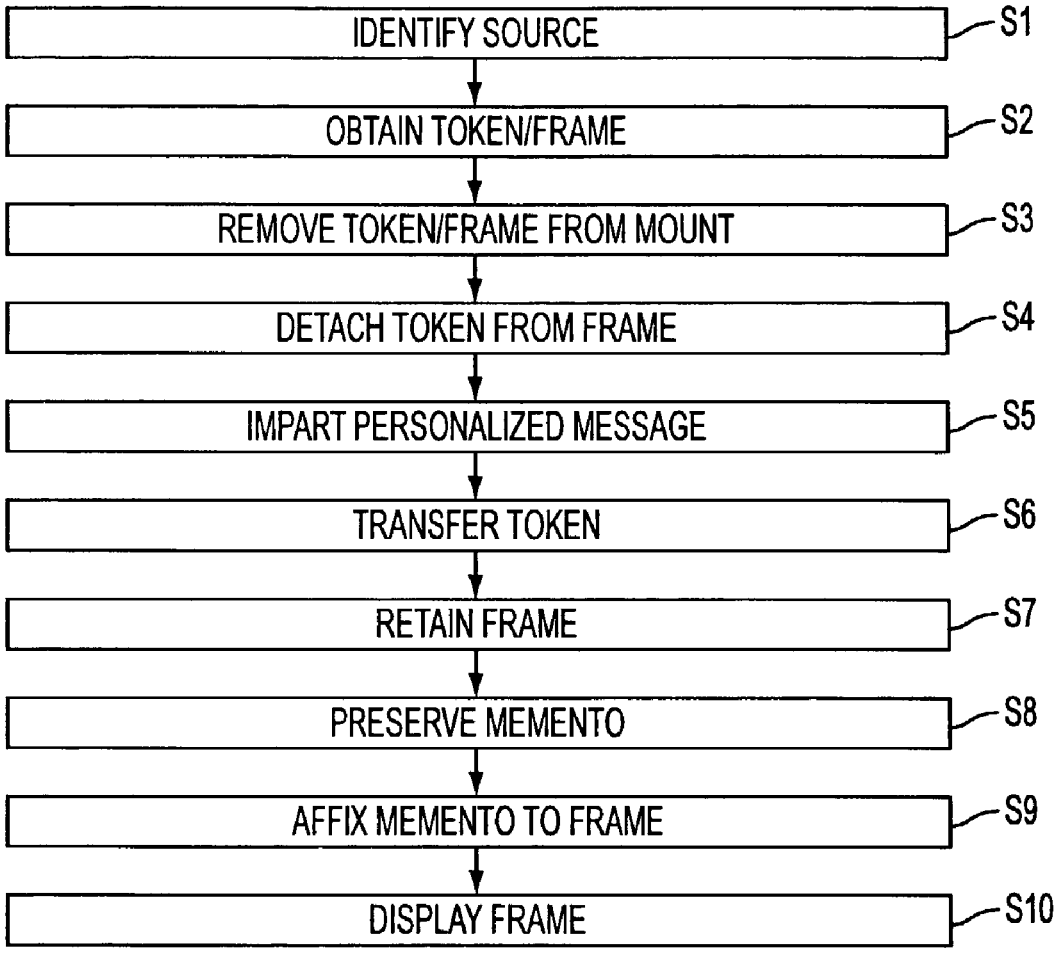
FIG. 6 shows a flow chart of an example of the method in a preferred embodiment for therapeutic use by a person to process emotions and cognitions relating to an emotion triggering event.
Figure 7:
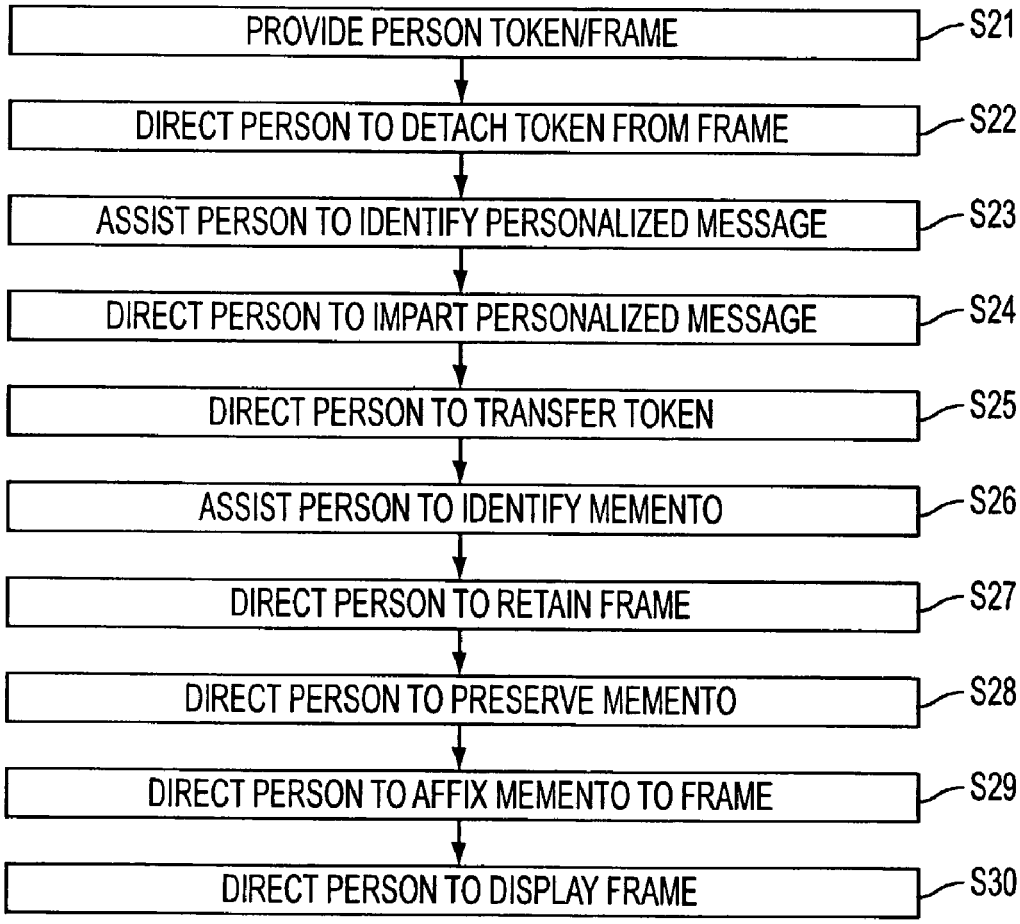
FIG. 7 shows a flow chart of an example of the method in a preferred embodiment for therapeutic use by therapists providing therapy to a person to process emotions and cognitions relating to an emotion triggering event.

20 Apparatus (token and frame, border, decorations, preserving means, displaying means, attaching means)
21 Apparatus (token and frame, border, first construction material, second construction material, third construction material)
22 Apparatus (preserving means, displaying means, memento, decoration, frame, detached token, inscription, personalized message)
23 Apparatus (preserving means, displaying means, attaching means, mount, decorations, terms suggesting a personalized message, directions for use, token and frame, border, protecting means)
24 Token
26 Frame
28 Face of token
28*a* Face of frame
30 Border
32 Decoration on face of token
32*a* Decoration on face of frame
32*b* Decoration on face of mount
34 Personalized message
35 Inscription
36 Surface of token
36*a* Surface of frame
38 Hangtag
38*a* Magnet
38*b* Support
40 Preserving means
42 Attaching means
44 Memento
50 Mount
52 Face of mount
54 Direction for use
56 Term suggesting a personalized message
58 Identifier
60 Third construction material
61 Second construction material
62 First construction material
66 Protecting means
S1 Identify source
S2 Obtain token and frame
S3 Remove token and frame from mount
S4 Detach token from frame
S5 impart personalized message
S6 Transfer token
S7 Retain frame
S8 Preserve memento
S9 Affix memento to frame
S10 Display frame
S21 Provide person token and frame
S22 Direct person to detach token from frame;
S23 Assist person to identify personalized message
S24 Direct person to impart personalized message
S25 Direct person to transfer token
S26 Assist person to identify memento
S27 Direct person to retain frame
S28 Direct person to preserve memento
S29 Direct person to affix memento to frame
S30 Direct person to display frame

DETAILED DESCRIPTION OF THE INVENTION

The present invention is directed to therapeutic methods and apparatuses for processing emotions or cognitions relating to an emotion triggering event. Referring now to the figures, in which like numerals represent like elements, an actual embodiment of the present invention will be described. Although aspects of the invention will be described in the general context of human psychology and therapeutic devices, those skilled in the art will recognize that the invention also may be implemented more broadly. Moreover, those skilled in the art will appreciate that the invention may be practiced with other configurations, in other environments, and with other possible implementations.

The following examples are provided in order to demonstrate and to further illustrate certain preferred embodiments and aspects of the present invention and are not to be construed as limiting the scope thereof.

Example 1

A preferred embodiment of the apparatus (20) may include a first construction material (62), such as (for example, a ten-point thickness) flat, white, gloss-coated cover stock or other material constructed substantially of plant fibers, which may be printed in a four-color process with soy-based inks to create a decoration on a front face of the stock. The front face of the printed stock may then be coated with an aqueous coating, such as a varnish, and a back surface of the printed stock may be subsequently laminated with means for fixation, such as an adhesive, to a second construction material (61), such as (for example, a fifty-point thickness) paper board or other material constructed substantially of plant fibers. A back surface of the board may then be laminated with means for fixation, such as an adhesive, to a front face of a third construction material (60), such as (for example, a seven-point thickness) flat, white, uncoated, unprinted, return card stock or other material constructed substantially of plant fibers, in order to form a composite sheet. The composite sheet may then be die-cut to create a frame (26), in the form of a six-inch diameter circle, and within the frame a border (30), in the form of a three-and-one-half inch diameter centered circle, surrounding a token (24). The token (24) may be in the form of a three-and-one-half inch diameter circle and may be attached to the frame (26) at the border (30), such as by pressure or by one or more tics (a small amount of a connecting material). The token (24) may be detachable from the frame (26) without significantly deforming the frame (26) or the token (24), such as by the pressure provided by a hand gently pressing against the token (24) while holding the frame (26). In one form, the printing may include a decoration (32) on a face of the token (28) that may form a symbolic connection with a decoration (32*a*) on a face of the frame (28*a*), more particularly a butterfly on a flower decoration (32) that symbolically interacts with a multiple flower decoration (32*a*). A surface of the token (36) may be specifically configured for imparting a personalized message (34) relating to a source of an emotion triggering event—or more particularly to a separation source or to a deceased—such as by limiting the size of the message to an appropriate length or by facilitating handwriting. In another form, the surface of the token (36) or a surface of the frame (36*a*) may be printed and the printing may include a decoration on the surface of the token (36) or a decoration on the surface of the frame (36*a*).

The back surface of the composite frame and token may be detachably attached, such as by spot gluing or fugitive gluing, to a face (52) of a mount (50), such as a seven-and-one-half inch by nine-and-one-half inch, rectangular, eighteen-point thickness cover stock backer. The face of the mount (52) may be printed, such as by using a four-color process, and may be coated, such as with an aqueous coating. In one form, the printing on the face of the mount (52) may have at least one direction for using the apparatus (54), may have at least one term suggesting the personalized message to be imparted (56), may have at least one identifier (58) (such as the trademarked name of a company, a slogan, or other identifying information, which may or may not suggest or direct a use), and may have at least one decoration (32*b*) (for example, a first mount decoration (32*b*) may form a symbolic connection with a decoration on the face of the token (32) or on the face of the frame (32*a*), or more particularly the first mount decoration (32*b*) may form a six-inch diameter centered circle—corresponding to the size of the frame and to which the token (24) and the frame (26) are detachably attached—and a second mount decoration (32*b*) may form a pair of hands that appear to hold the detachably attached token and frame).

A surface of the mount may be detachably attached, such as by spot gluing or fugitive gluing, to means for preserving a memento (40), such as a transparent covering (for example, a four-inch, square, transparent plastic sleeve, which may have an opening for inserting items into the sleeve and may have means for sealing and unsealing the opening). In one form, means for attaching (42) the preserving means (40) to the frame, such as at least one adhesive strip, may be included with the preserving means (40), such as by enclosing the attaching means within the transparent covering. In another form, means for displaying the memento, such as at least one hangtag (38), at least one magnet (38*a*), or at least one support (38*b*) (which may be formed of cardboard or other material) may be included with the preserving means (40), such as by enclosing the displaying means within the preserving means.

The token (24) and frame (26), mount (50), preserving means (40), attaching means (42), and displaying means may be included with means for protecting (66) these elements (such as by enclosing these elements in a transparent plastic protective envelope, which may be sealed, such as by a heat seal, a pressure seal, or by a zip-lock or other reusable closure). The apparatus so configured may then be ready for distribution and use.

In use, the token (24) and frame (26) may be removed from the mount (50), the token (24) may be detached from the frame (26), and a personalized message relating to a source of an emotion triggering event (34) may be imparted to the token (24) before, during, or after separation from the frame (26). The personalized message (34) may be imparted to the surface of the token (36). The token (24) may then be transferred to a significant location relating to the source, such as at, near, in, on, around, etc., a grave marker, a grave site, a favorite tree, a body of water, etc.

The frame (24) may be retained and a memento (44) relating to the source, such as a photograph of a source, may be affixed to the frame (24), with or without preserving means (40), such as by inserting the memento (44) into a transparent covering and attaching the covering to the frame with attaching means (42), such as at least one adhesive strip. The frame may be situated in a location to display the memento, such as on top of a dresser in a bedroom, and displaying means, such as a hangtag (38), a magnet (38*a*), or a support (38*b*), may be included with the frame, such as by fastening the displaying means to the frame (26) with an adhesive, glue, staples, tape, clips, clamps, nails, screws, etc.

It will be apparent to those skilled in the art that the apparatus may be made of thin wood, plastic, composites, leather, metal, and other materials, with or without being configured to impart a personalized message (34) or to affix a memento (44), and with or without the token (24) having an imparted personalized message (34) on a face (28) (which may include a front face) or a surface (36) (which may include a back surface), and with or without having a memento (44) affixed to the frame (26), and may be formed by additional processes, such as molding, casting, etc. The method and sequence of making the token and frame, the mount, the protecting means, the preserving means, the displaying means, or the attaching means may be varied. The token (24) and frame (26) may be constructed of a single construction material or a plurality of construction materials, with or without a plurality of layers, with or without lamination, from a variety of enumerated and unenumerated construction materials of varying thicknesses, shapes, and qualities with the token (24) configured to impart a personalized message (34) on the token, including but not limited to on a surface of the token (36) or on a face of the token (28). The mount (50), preserving means (40), displaying means, attaching means (42), and protecting means (66) may be constructed of a single material or a plurality of materials, with or without a plurality of layers with or without lamination, from a variety of enumerated and unenumerated construction materials of varying thicknesses, shapes, and qualities. Other methods of printing, including but not limited to other methods or imparting other types of inks, pigments, etc., and other methods of imparting decorations, inscriptions, terms, directions for use, and other expressive features may be employed. Other coatings, such as lacquers, shellacs, etc., and no coatings may be employed. The detachable attachment between the frame (26) and the token (24) may be formed by a variety of techniques, including but not limited to perforation, tics, staples, tape, clips, clamps, etc., or making a snug fit relying only on a pressure contact between the frame (26) and the token (24), and a variety of methods for forming such detachable attachments other than die cutting may be employed, such as laser-cutting, molding, casting, etc. The apparatus may lend itself to the production of jewelry and other tangible objects with the same or additional methods, or formed from the apparatus by the same or additional methods. The shape or dimension of the token (24) or of the frame (26) may be varied substantially to achieve other objectives, and may form symbolic or functional shapes. The shape of the token (24), the border (30), and the frame (26) may vary dependently or independently of each other or of a decoration printed on or otherwise included with the token (24) or frame (26) or to a decoration printed on or otherwise included with a mount (32*b*). The personalized message (34) may be imparted to any part of the token (24), whether or not the personalized message (34) is a hand inscription. The token (24) may be configured with or without a printed inscription (35), decoration (32), direction for use (54), term suggesting a personalized message (56), or identifier (58), and may be transferred to the source with or without imparting a personalized message (34). The frame may be configured with or without a printed inscription (35), decoration (32*a*), direction for use (54), term suggesting a personalized message (56), or identifier (58), and may be retained or may not be retained, with or without affixing, preserving, or displaying a memento. A memento (44) may be affixed to the frame (26) with or without preserving means (40) or displaying means. Means for affixing a memento to the frame include but are not limited to insertion into an attached covering, insertion into an opening in the frame (such as an aperture, sleeve, or at least one insertion point), or other fastening means, including but not limited to adhesive strips, glue, tape, staples, clips, clamps, etc. Preserving means (40) may be included with or without means of attaching (42) to the frame. Preserving means may include coverings, sleeves, coatings, wrappings, temperature controls, injected materials, etc. Attaching means (42) may include adhesive strips or other fasteners, including but not limited to glue, staples, tape, clips, clamps, etc. Displaying means may include a hangtag (38), a magnet (38*a*), a support (38*b*), or other similar means, including but not limited to adhesives, glue, staples, tape, clips, clamps, nails, screws, etc., whether or not fastened to or otherwise included with the frame. The apparatus may be configured with or without protecting means. Protecting means may include an envelope, a box, a wrapper, batting material, packaging materials, etc. The mount may be configured with or without a printed inscription (35), decoration (32*b*), direction for use (54), term suggesting a personalized message (56), or identifier (58). The apparatus may be configured with or without a printed inscription (35), decoration, direction for use (54), term suggesting a personalized message (56), or identifier (58) separated from the token (24), the frame (26), or the mount (50). A token decoration (32), a frame decoration (32*a*), or a mount decoration (32*b*) may include all forms of handwriting, printing, ornamentation, artistic media, analog or digital sound or video recordings, multi-media, mono-media, photography, and other means of fixing expression. Ornamentation to form a decoration may include addition of foreign substances such as feathers, glitter, fabric, embroidery, metallic, holographic, or other finishes, etc. Ornamentation also may be achieved by other processes, such as stamping, embossing, carving, or other processes for modifying a material. An identifier may include a trademark, a slogan, or other identifying information, which may or may not suggest or direct a use, such as identifying words, shapes, symbols, etc. Decoration may be included on a surface of the token, the frame, or the mount. The personalized message (34) may comprise hand writings, printed writings, typewritten and computer-generated documents, drawings and other art works, graphic designs, ornamentation, collages, non-verbal items having symbolic significance (such as sound and video recordings, food, and other items), etc., that may be imparted by inscription or other process for attachment or fixation (including but not limited to the attaching means or affixing means described above) to the token (24). The memento (44) may comprise a wide range of objects and artifacts (such as writings, photographs, sound and video recordings, hair and other body parts, imprints—such as fingerprints or paw prints—made from body parts, personal belongings, identification tags, flowers from funeral or memorial services, keys, artistic works, etc.).

Example 2

An alternative preferred embodiment of the apparatus (22) may include a token (24) detached from and located remotely to a frame (26). The token and frame may be constructed as described in paragraphs above, incorporated herein by reference, except that the die-cut sheet may create a frame (26) in the form of a different symbolic shape (more particularly a heart approximately six inches high and five inches wide), the border (30) may form a different symbolic shape (more particularly a heart approximately three inches high and two inches wide), the token (24) may be in the form of a different symbolic shape (more particularly a heart approximately three inches high and two inches wide), the token (24) may be detached from the frame without significantly deforming the token (24) or the frame (26), the printing may include an inscription (35) on the face of the token (28) (more particularly a quote from William Butler Yeats' *The Second Coming* "Things fall apart; the center cannot hold"), and the frame may include a decoration (32*a*) on the face of the frame (28*a*) selected from the group of common cultural images associated with bereavement (more particularly an American flag). The personalized message (34), such as a handwritten note (more particularly the words "I Love You"), may be imparted to the token, including on a surface (36) or a face (28) of the token (24). The token (24) may be located at a significant location relating to a source of an emotion triggering event (more particularly to a separation source, and even more particularly to a deceased), such as at, near, in, on, around, etc., a grave marker, a grave site, a favorite tree, a body of water, etc. A memento (44) (more particularly a photograph of the source), may be affixed to the frame (26), such as by including it in means for preserving the memento (40) (for example, a transparent covering, attached to the frame (26) by attaching means (42) (more particularly by inserting the photograph in a transparent covering—such as a four-inch square, transparent plastic sleeve, which may have an opening for insertion and may have means for sealing and unsealing the opening—and attaching the covering to the frame using at least one adhesive strip). The frame (26) may be situated in a location to display the memento (44), such as a location where the memento (44) will be viewed by the person experiencing emotions or cognitions or by others who know, knew, or will know of the source of the emotion triggering event (more particularly a bedroom dresser of the person, a wall in the house of the person or the source, a refrigerator, a car, a desk, etc.). Displaying means (such as a hangtag (38), a magnet (38*a*), or a support (38*b*)) may be included with the frame, such as by fastening the displaying means to the frame (26) with an adhesive, glue, staples, tape, clips, clamps, nails, screws, etc.

In use, the token and frame may be used by a person experiencing emotions or cognitions relating to an emotion triggering event to provide or obtain therapy or may be used by another person to provide therapy to the person experiencing such emotions or cognitions.

One skilled in the art will recognize that the apparatus may include the additional elements or limitations in different combinations or permutations as described in paragraphs above, which are incorporated herein by reference. The significant location relating to a source may include a grave marker, a grave site, a favorite tree, a body of water, or another location, including but not limited to homes, hospitals, schools, churches, birthplaces, fields, the body or remains of the source, or other location significant to a person experiencing emotions or cognitions relating to an emotion triggering event or to the source of the emotion triggering event. The location to display the memento may include a bedroom dresser of the person, a wall in the house of the person or the source, a refrigerator, a car, a desk, or another location, including but not limited to any other location susceptible of display to the person, the source, or another person or animal that knows, knew, or will know of the source.

Example 3

A preferred embodiment of the therapeutic method may include the steps of: identifying a source of an emotion triggering event (S1), more particularly a separation source, and yet more particularly a deceased; obtaining a detachable token attached to a frame (S2), wherein a surface of the token may be configured for imparting a personalized message relating to the source, and wherein the token and frame may be attached to a mount; removing the token and frame from the mount (S3); detaching the token from the frame (S4); imparting to the token a personalized message relating to the source (S5); transferring the token to a significant location relating to the source (S6); retaining the frame (S7); preserving the memento (S8); affixing to the frame a memento relating to the source (S9); and displaying the frame (S10).

One skilled in the art will recognize that the method may be practiced with the additional elements or limitations in the different combinations or permutations described in paragraphs above, which are incorporated herein by reference. In various forms, the method includes the enumerated method as modified by reordering, adding to, or subtracting from the enumerated steps with other enumerated or unenumerated steps or features.

Example 4

An alternative preferred embodiment of the therapeutic method may include the steps of: providing a detachable token attached to a frame (S21) to a person experiencing emotions and cognitions relating to an emotion triggering event, more particularly a separation source and yet more particularly a deceased, wherein a surface of the token may be configured for imparting a personalized message relating to the source; directing the person to detach the token from the frame (S22); assisting the person to identify a personalized message relating to the source (S23); directing the person to impart to the token the personalized message (S24); directing the person to transfer the token to a significant location relating to the source (S25); assisting the person to identify a memento relating to the source (S26); directing the person to retain the frame (S27); directing the person to preserve the memento (S28); directing the person to affix to the frame the memento (S29); and directing the person to display the frame (S30).

One skilled in the art will recognize that the method may be practiced with the additional elements or limitations in the different combinations or permutations described in paragraphs above, which are incorporated herein by reference. In various forms, the method includes the enumerated method as modified by reordering, adding to, or subtracting from the enumerated steps with other enumerated or unenumerated steps or features.

All publications and patents mentioned in the above specification are herein incorporated by reference in their entirety. Various modifications and variations of the described method and system of the invention will be apparent to those skilled in the art without departing from the scope and spirit of the invention. Although the invention has been described in connection with specific preferred embodiments, it will be appreciated that various changes may be made thereto without departing from the spirit and scope of the invention and it will be understood that the invention as claimed is not limited to such specific embodiments. Indeed, unenumerated embodiments of the invention and various modifications of the described modes for carrying out the invention will be recognized by one skilled in the arts of human psychology and therapeutic devices or related fields, and unenumerated embodiments that may be developed without undue experimentation are intended to be within the scope of the following claims. Further, the invention includes all operable combinations and permutations of specifically enumerated elements or of features or limitations of the enumerated embodiments.

I claim:

1. An apparatus comprising:

a. a token having a surface configured for imparting a personalized message relating to a source of an emotion triggering event;

b. a frame detachably attached to the token, wherein the frame is configured for affixing a memento relating to the source; and c. a mount detachably attached to the frame.

2. The apparatus of claim 1, wherein the token forms a symbolic shape.

3. The apparatus of claim 2, wherein the frame forms a substantially circular border with the token.

4. The apparatus of claim 1, wherein the mount further comprises a backer.

5. The apparatus of claim 1, wherein the mount further comprises means, detachably attached to the mount, for preserving the memento.

6. The apparatus of claim 1, wherein the mount further comprises means, detachably attached to the mount, for displaying the memento.

7. The apparatus of claim 1, wherein the frame further comprises means for displaying the memento.

8. The apparatus of claim 1, wherein the frame further comprises means for preserving the memento.

9. The apparatus of claim 8, wherein the preserving means comprises a transparent covering.

10. The apparatus of claim 1, wherein:

a. the token forms a symbolic shape;

b. the frame forms a substantially circular border with the token;

c. the token further comprises a decoration on a face of the token;

d. the frame further comprises a decoration on a face of the frame;

e. the mount further comprises a backer;

f. the mount further comprises means, detachably attached to the mount, for preserving the memento;

g. the preserving means further comprises a transparent covering;

h. the mount further comprises means, detachably attached to the mount, for displaying the memento;

i. the displaying means further comprises a hangtag; and j. the token and the frame are constructed substantially of plant fibers.

11. An apparatus, comprising:

a. a token having a surface configured for imparting a personalized message relating to a source of an emotion triggering event;

b. a frame configured for affixing a memento relating to the source;

c. wherein the token is detachable from the frame; and d. a memento affixed to the frame.

12. The apparatus of claim 11, wherein the frame is situated in a location to display the memento.

13. The apparatus of claim 11, wherein the frame further comprises means for displaying the memento.

14. The apparatus of claim 11, wherein the frame further comprises means for preserving the memento.

15. The apparatus of claim 11, further comprising a mount detachably attached to the frame.

* * * * *